US008557360B2

(12) United States Patent
Yamada

(10) Patent No.: US 8,557,360 B2
(45) Date of Patent: Oct. 15, 2013

(54) CLEANING SHEET

(76) Inventor: Kikuo Yamada, Tokyo (JP)

( * ) Notice: Subject to any disclaimer, the term of this patent is extended or adjusted under 35 U.S.C. 154(b) by 267 days.

(21) Appl. No.: 13/124,806

(22) PCT Filed: Oct. 23, 2009

(86) PCT No.: PCT/JP2009/005605
§ 371 (c)(1),
(2), (4) Date: Apr. 18, 2011

(87) PCT Pub. No.: WO2010/047130
PCT Pub. Date: Apr. 29, 2010

(65) Prior Publication Data

US 2011/0203067 A1 Aug. 25, 2011

(30) Foreign Application Priority Data

Oct. 24, 2008 (JP) ..... 2008-274707

(51) Int. Cl.
*B32B 33/00* (2006.01)
*B65D 65/24* (2006.01)
*B65D 65/28* (2006.01)
*A47L 13/00* (2006.01)

(52) U.S. Cl.
USPC ..... 428/40.1; 15/104.001; 428/41.8; 428/42.2; 428/43

(58) Field of Classification Search
USPC ..... 428/40.1, 41.6, 41.8, 42.2, 43; 15/104.002, 229.1–229.9, 209.1, 223, 15/224, 226, 227, 230
See application file for complete search history.

(56) References Cited

U.S. PATENT DOCUMENTS

| | | | | |
|---|---|---|---|---|
| 5,280,664 | A | 1/1994 | Lin | |
| 6,329,308 | B1 | 12/2001 | Kenmochi et al. | |
| 6,810,554 | B2 * | 11/2004 | McKay | 15/228 |
| 7,917,985 | B2 * | 4/2011 | Dorsey et al. | 15/118 |
| 2004/0031119 | A1 | 2/2004 | McKay | |
| 2005/0268419 | A1 | 12/2005 | Tanaka | |
| 2006/0137119 | A1 | 6/2006 | Otsuka et al. | |

FOREIGN PATENT DOCUMENTS

| | | |
|---|---|---|
| JP | A-09-135798 | 5/1997 |
| JP | A-10-225408 | 8/1998 |
| JP | A-11-128156 | 5/1999 |

(Continued)

OTHER PUBLICATIONS

Mar. 20, 2012 Extended European Search Report issued in European Patent Application No. 09821830.8.

(Continued)

*Primary Examiner* — Patricia Nordmeyer
(74) *Attorney, Agent, or Firm* — Oliff & Berridge, PLC

(57) ABSTRACT

An inexpensive cleaning sheet is provided which attains an excellent cleaning efficiency and with which even large dust particles or heavy dust particles can be easily caught. The cleaning sheet is obtained by bonding a cleaning-side sheet to a base sheet at bonding areas, interposing a strip between the base sheet and the cleaning-side sheet, bonding the strip to the cleaning-side sheet, with one end of the strip projecting outward from the cleaning-side sheet, forming a perforation for cutting off in the cleaning-side sheet, and forming a pressure-sensitive adhesive layer on the surface of the base sheet which faces the region of the cleaning-side sheet surrounded by the perforation. This cleaning-side sheet is configured so that the region of the cleaning-side sheet surrounded by the perforation is cut off by pulling the strip.

12 Claims, 7 Drawing Sheets

(56) References Cited

FOREIGN PATENT DOCUMENTS

| | | |
|---|---|---|
| JP | A-2004-208939 | 7/2004 |
| JP | A-2005-013642 | 1/2005 |
| JP | U-3111305 | 7/2005 |
| JP | A-2005-342257 | 12/2005 |

OTHER PUBLICATIONS

International Preliminary Report on Patentability issued in Application No. PCT/JP2009/005605; Dated May 17, 2011.
International Search Report issued in Application No. PCT/JP2009/005605; Dated Dec. 1, 2009 (With Translation).

* cited by examiner

CLEANING SHEET

TECHNICAL FIELD

The present invention relates to a cleaning sheet to be used as a cleaning tool for wiping a cleaned side.

BACKGROUND ART

As a tool for wiping off dust and dirt particles attached to the floor, wall, and window frame of a building as well as desks, lighting equipment, electric appliances which are placed indoors, a cleaning tool which performs cleaning by attaching a sheet with a cleaning function to the end of a handle is known. As a cleaning sheet to be attached to such a cleaning tool for use, a cleaning sheet for floor cleaning mop in which long-fiber is bonded to nonwoven fabric and the fiber layer is used as a cleaning side is known (for example, Patent Literature 1).

A cleaning sheet for handy mop in which a sheet is formed of nonwoven fabric and the nonwoven fabric layer is used as a cleaning side is also known (for example, Patent Literature 2).

In the cleaning sheets disclosed in Patent Literatures 1 and 2, small dust particles and light dust particles are removed. However, the dust-catching capacity for large dust particles or heavy dust particles (for example, dust particles, such as grains of rice and small pieces of metal) is low. There has been a problem where those dust particles are not sufficiently removed.

In those conventional cleaning sheets, there is a defect such that some of dust and dirt particles which have been caught by sweeping and collecting them once are detached and fallen from the sheet surface thereafter.

On the other hand, a cleaning tool configured such that dust and dirt particles on the cleaned side are caught by rotatably supporting a roller at the end of a handle, winding a cleaning sheet having an adhesive surface for cleaning around the peripheral surface of the roller, and rolling the roller on the cleaned side is proposed (for example, Patent Literature 3).

CITATION LIST

Patent Literatures

Patent Literature 1: Japanese Patent Application Laid-Open (JP-A) No. 9-135798
Patent Literature 2: JP-A No. 10-225408
Patent Literature 3: JP-A No. 2005-13642

DISCLOSURE OF THE INVENTION

Problems to be Solved by the Invention

Since the cleaning sheet disclosed in Patent Literature 3 are configured to catch dust and dirt particles by adhesive force, it can catch large dust particles or heavy dust particles. Although the detachment of the dust and dirt particles which have been caught once can be prevented, the cleaning capacity is lost after the attachment of the dust particles to the adhesive surface because of cleaning only by adhesive face. Thus, an operation that the cleaning sheet without the cleaning capacity is detached from the roller surface and a new cleaning sheet is attached needs to be performed frequently, which is cumbersome.

Since the cleaning-side forming portion formed on the roller surface has a circular curved surface, its contact area to the cleaned side is small. Therefore, the cleaning efficiency is bad and the sheet is not suitable for cleaning the cleaned side with a large area. Further, the whole surface of the sheet is configured as an adhesive surface using a pressure-sensitive adhesive. Accordingly, there is a defect that the production cost of the cleaning sheet is expensive.

The present invention has been made in view of the above circumstances. An object of the present invention is to provide an inexpensive cleaning sheet which attains an excellent cleaning efficiency and with which even large dust particles or heavy dust particles can be easily caught.

Means for Solving the Problems

The present invention is a cleaning sheet obtained by bonding a cleaning-side sheet to a base sheet at bonding areas, interposing a strip between the base sheet and the cleaning-side sheet, bonding the strip to the cleaning-side sheet, with one end of the strip projecting outward from the cleaning-side sheet, forming a perforation for cutting off in the cleaning-side sheet, and forming a pressure-sensitive adhesive layer on the surface of the base sheet which faces the region of the cleaning-side sheet surrounded by the perforation.

A nonbonded area is formed in the bonding areas at an edge portion at one side among the bonding areas between the base sheet and the cleaning-side sheet and one end of the strip is projected outward from the cleaning-side sheet through a gap portion between the base sheet and the cleaning-side sheet in the nonbonded area.

The cleaning-side sheet is configured so that the region of the cleaning-side sheet surrounded by the perforation is cut off by pulling the strip.

The pressure-sensitive adhesive layer is formed in a downward position from the cleaning-side sheet of the region so as to be exposed outward by cutting off the cleaning-side sheet in the region surrounded by the perforation.

A perforation may have a structure which is cut off when pulling a strip and can be configured, for example, as a perforation with a form that a lot of dot-shaped cut portions are successively formed.

A release agent layer is formed on the surface of the strip facing a pressure-sensitive adhesive layer.

A region where a base sheet is exposed outward from an edge portion of a cleaning-side sheet is formed and the region is configured as an attaching portion.

A projection portion of the strip is formed as a knob portion. The strip can be pulled by the knob portion. The knob portion of the strip is temporary joined to the attaching portion by dot-bonding. It is configured that the knob portion temporary jointed is detached from the attaching portion when performing an operation for exposing the pressure-sensitive adhesive layer by pulling the strip.

It is preferable that a mark for pulling out with coloring is formed in the strip. Such a configuration allows for the recognition of the moving distance by pulling the strip. A lot of cut lines or small holes can be formed in the cleaning-side sheet.

The cleaning sheet of the present invention can be configured as a cleaning-side swelling structure in which the cleaning-side sheet with being bent into an arch shape is bonded to the base sheet. In this structure, a space portion is formed between the cleaning-side sheet and the base sheet.

Effects of the Invention

The cleaning sheet of the present invention is obtained by bonding a cleaning-side sheet to a base sheet at bonding areas, interposing a strip between the base sheet and the cleaning-side sheet, bonding the strip to the cleaning-side sheet, with one end of the strip projecting outward from the cleaning-side sheet, forming a perforation for cutting off in the cleaning-side sheet, and forming a pressure-sensitive adhesive layer on the surface of the base sheet which faces the region of the cleaning-side sheet surrounded by the perforation. Therefore, it can catch the large dust particles or the heavy dust particles, such as grains of rice and small pieces of metal easily.

That is, the perforation is broken by pulling the strip and the cleaning-side sheet in the region surrounded by the perforation is cut off. As a result, a cut piece is formed and the cut piece is moved by pulling the strip, thereby exposing the pressure-sensitive adhesive layer. Thus, when the surface of the pressure-sensitive adhesive layer is pressed against the large dust particles or the heavy dust particles, those dust particles are attached and caught to the pressure-sensitive adhesive layer.

Thus, according to the present invention, there is an effect that not only small and light dust particles, but also large or heavy dust particles which are usually difficult to wipe off can be easily wiped off.

Since the cleaning sheet of the present invention can be produced to have the same size as those of general cleaning sheets, a contact area to the cleaned side is sufficiently large, and thus the cleaning sheet has excellent cleaning efficiency.

The cleaning sheet of the present invention is not configured such that the whole surface of a cleaning side portion is an adhesive surface. Thus, there is an advantage that production cost is also inexpensive.

BRIEF DESCRIPTION OF THE DRAWINGS

FIG. 1 is the cleaning sheet with a cleaning-side swelling structure.

BEST MODES FOR CARRYING OUT THE INVENTION

Figure 1:
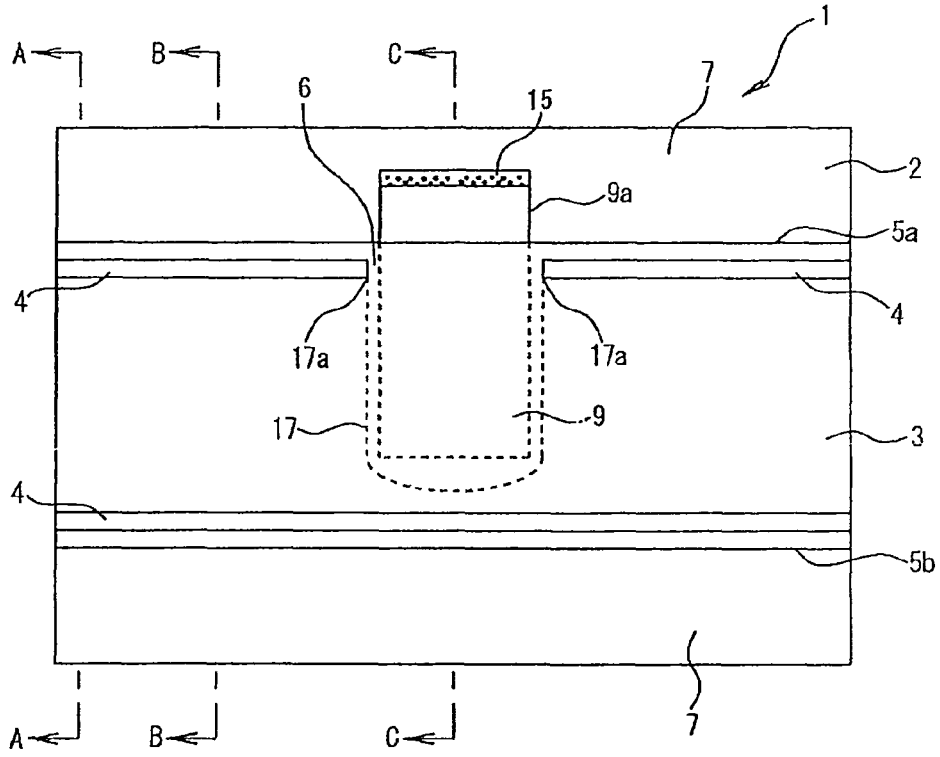
FIG. 1 is a plan view of a cleaning sheet of the present invention.

FIG. 1 shows an example of a cleaning sheet of the present invention. A cleaning sheet 1 includes a base sheet 2 and a cleaning-side sheet 3. The cleaning-side sheet 3 is a sheet portion which achieves a function of abutting on the cleaned side to clean the cleaned side, and it is superimposed on the base sheet 2 and is bonded to the base sheet 2 at bonding areas 4.

The bonding areas 4 are formed by heat-sealing near each of an edge portion 5*a* at one side of the cleaning-side sheet 3 and an edge portion 5*b* at the other side and linearly thermal-fusing the cleaning-side sheet 3 and the base sheet 2. In this case, the bonding areas 4 in the edge portion 5*a* at one side are not continuously formed, the heat sealed line is broken in the middle, and a nonbonded area 6 with a predetermined width is formed near the central part.

Usable examples of the base sheet 2 include a nonwoven fabric sheet and a plastic sheet. Preferably, the nonwoven fabric sheet is used. Usable examples of materials of the nonwoven fabric sheet include spun-laced nonwoven fabrics, spun-bonded nonwoven fabrics, thermal-bonded nonwoven fabrics, air-through nonwoven fabrics, and point-bonded nonwoven fabrics.

As a fiber which is a component of nonwoven fabric, hydrophilic fibers such as rayon, cotton, or nylon (registered trademark) and lipophilic fibers such as polypropylene, acryl, or polyester are used alone or mixed for use.

Usable examples of materials of the plastic sheets include polypropylene, polyethylene, and polyester.

A means for bonding the cleaning-side sheet 3 to the base sheet 2 is not limited to the heat sealing as described above and an adhesive bonding may be used. Therefore, in the present invention, materials of the base sheet 2 and the cleaning-side sheet 3 are not limited to materials capable of thermal fusing. Usable examples of the adhesive include a hot melt adhesive, a two-liquid curable adhesive, and a thermoplastic resin adhesive. Among them, the hot melt adhesive is preferably used.

As a means for bonding the cleaning-side sheet 3 to the base sheet 2, a bonding by ultrasonic sealing can also be used.

As the cleaning-side sheet 3, a nonwoven fabric sheet is preferably used. In this case, as the material of the nonwoven fabric sheet, the same material as the material of the nonwoven fabric sheet to be used for the base sheet 2 can be used. As for the constituent fiber of the nonwoven fabric, the same fiber as the constituent fiber of the nonwoven fabric to be used for the base sheet 2 can be used.

The base sheet 2 and the cleaning-side sheet 3 are formed into a rectangular shape. The length in the short side direction of the base sheet 2 is longer than that in the short side direction of the cleaning-side sheet 3. Thus, when the cleaning-side sheet 3 is superimposed on the base sheet 2 for bonding, a region in which the base sheet 2 is exposed outward from the edge portions 5*a* and 5*b* of the cleaning-side sheet 3 is formed. The exposed region of the base sheet 2 forms an attaching portion 7 for attaching the cleaning sheet 1 to a base plate of the cleaning apparatus as described later.

Figure 3:
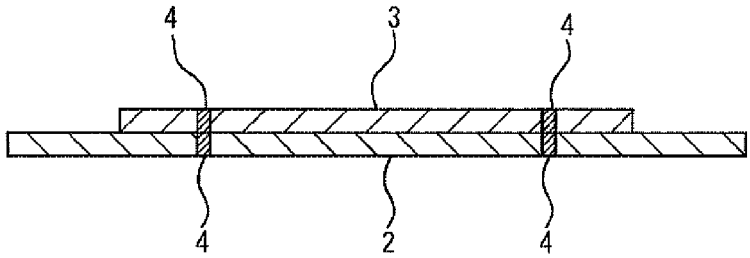
FIG. 3 is a longitudinal sectional view of an A-A line in FIG. 1.
Figure 5:
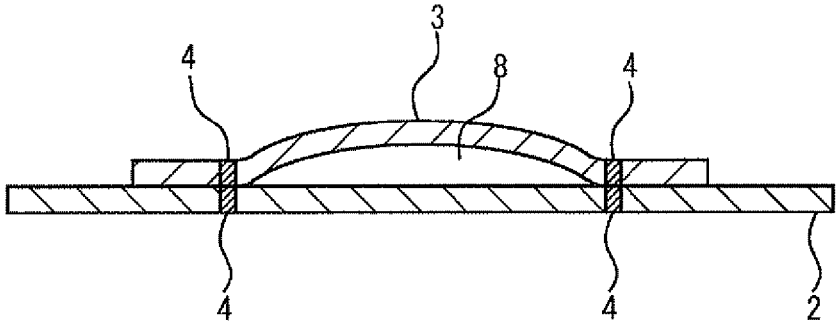
FIG. 5 is a longitudinal sectional view of an A-A line in FIG. 1 if

Examples of the structure of attaching the cleaning-side sheet 3 to the base sheet 2 include an embodiment in which the cleaning-side sheet 3 and the base sheet 2 are flatly superimposed as shown in FIG. 3 (hereinafter, such a structure is referred to as a cleaning-side flat structure) and an embodiment in which the cleaning-side sheet 3 is bent into an arch shape and the sheets 2 and 3 are superimposed so as to form a space portion 8 between both of the sheets 2 and 3 as shown in FIG. 5 (hereinafter, such a structure is referred to as a cleaning-side swelling structure). FIG. 3 shows a longitudinal sectional view of an A-A line in FIG. 1. FIG. 5 is a longitudinal sectional view of an A-A line in FIG. 1 if FIG. 1 is the cleaning sheet with a cleaning-side swelling structure.

Figure 2:
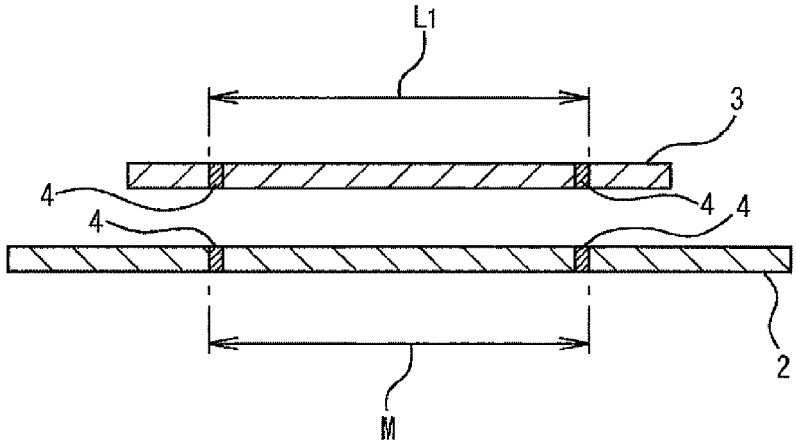
FIG. 2 is an explanatory view showing a relationship of distance between bonding areas in a cleaning sheet with a cleaning-side flat structure.

In order to form the cleaning sheet 1 into the cleaning-side flat structure, a distance $L_1$ between the bonding areas 4 and 4 with the base sheet 2 in the cleaning-side sheet 3 may be configured to be the same as a distance M between the bonding areas 4 and 4 with the cleaning-side sheet 3 in the base sheet 2 as shown in FIG. 2. That is, both the cleaning-side sheet 3 and the base sheet 2 are flatly superimposed and bonded by heat sealing to obtain the cleaning sheet 1 with a cleaning-side flat structure.

Figure 4:
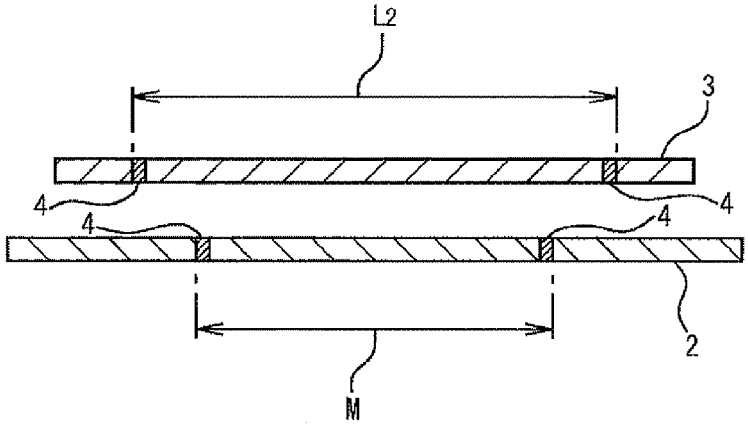
FIG. 4 is an explanatory view showing a relationship of distance between bonding areas in a cleaning sheet with a cleaning-side swelling structure.

On the other hand, in order to form the cleaning sheet 1 into the cleaning-side swelling structure, when the cleaning-side sheet 3 is flatly unfolded, a direct distance $L_2$ between the bonding areas 4 and 4 with the base sheet 2 in the cleaning-side sheet 3 is configured to be longer than the distance M between bonding the areas 4 and 4 with the cleaning-side sheet 3 in the base sheet 2 as shown in FIG. 4. In the state that both the cleaning-side sheet 3 and the base sheet 2 are bonded, the distance $L_2$ between the bonding areas 4 and 4 is equal to the distance M. Thus, in the bonded state, the cleaning-side sheet 3 is projected upward and the shape is deformed.

That is, the cleaning-side sheet 3 is bent into an arch shape and superimposed on the base sheet 2, followed by bonding by heat sealing to obtain the cleaning sheet 1 with a cleaning-side swelling structure.

Figure 7:
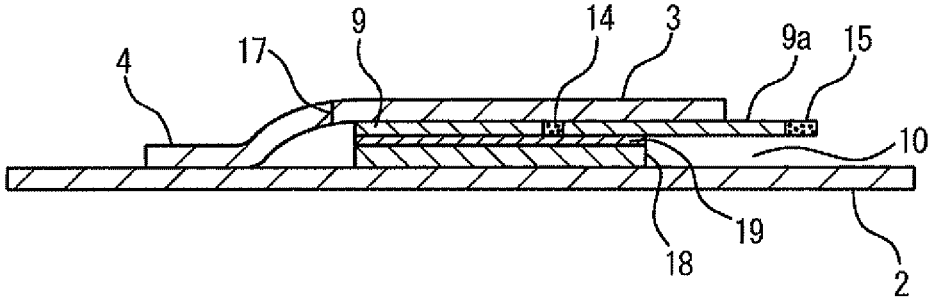
FIG. 7 is a longitudinal sectional view of a C-C line in FIG. 1.

FIG. 7 shows a longitudinal sectional view of a C-C line in FIG. 1. In FIG. 7, the cleaning-side sheet 3 is illustrated as if it is swollen upward on the base sheet 2. This is because it is intended to be illustrated in such a manner in order to clearly illustrate an internal structure appearing in a longitudinal section of a C-C line. FIGS. 1 and 7 are not the sheet with the cleaning-side swelling structure shown in FIG. 5, but the sheet with the cleaning-side flat structure shown in FIG. 3.

Figure 6:
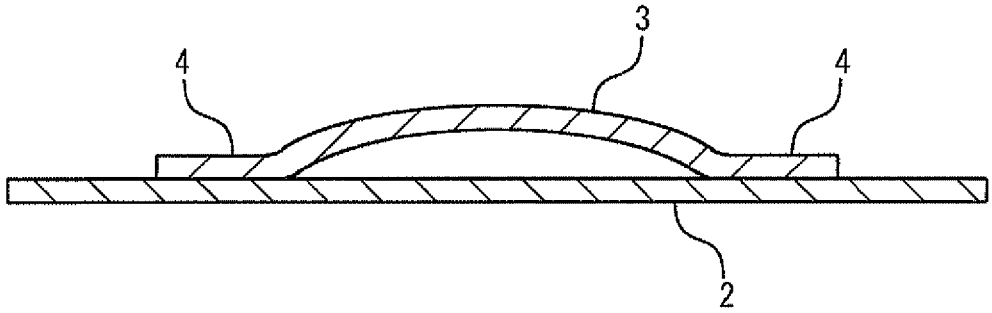
FIG. 6 is a longitudinal sectional view of a B-B line in FIG. 1.

FIG. 6 showing the longitudinal sectional view of a B-B line in FIG. 1 is illustrated as a diagram in which the cleaning-side sheet 3 is swollen upward from the base sheet 2 in order to make it correspond to FIG. 7. Further, FIG. 6 is not the sheet with the cleaning-side swelling structure, but the sheet with the cleaning-side flat structure.

As described above, the nonbonded area 6 with a predetermined width is formed in the bonding areas 4 at the edge portion 5*a* at one side among the bonding areas between the base sheet 2 and the cleaning-side sheet 3.

On the other hand, the strip 9 for cutting off with a rectangular shape is interposed between the base sheet 2 and the cleaning-side sheets 3. One end of the strip 9 is projected outward from the cleaning-side sheet 3 through a gap portion 10 between the base sheet 2 and the cleaning-side sheet 3 in the nonbonded area 6.

Figure 8:
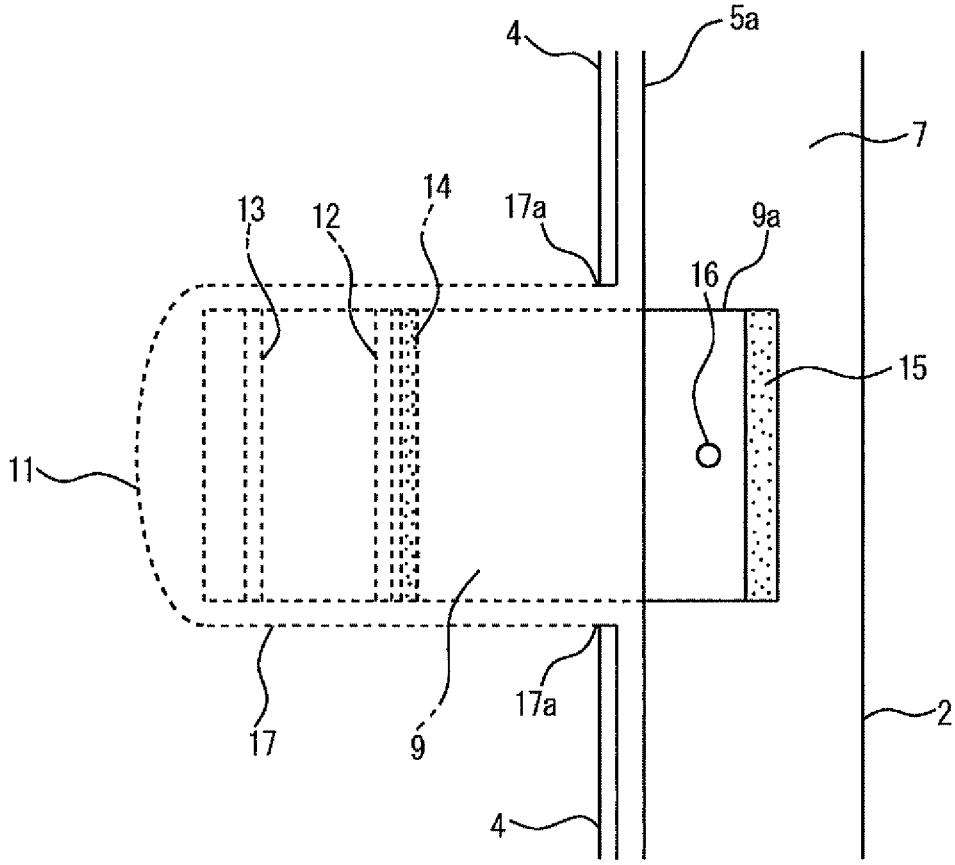
FIG. 8 is a main part plan view showing a cleaning-side sheet in which a perforation for cutting off is formed.

The strip 9 interposed between the base sheet 2 and the cleaning-side sheets 3 is bonded to the back surface of the cleaning-side sheet 3. In FIG. 8, reference numerals 12 and 13 denote bonding areas of the strip 9 and the cleaning-side sheet 3.

One end of the strip 9 is projected outward from the edge portion 5*a* of the cleaning-side sheet 3 and the projected portion forms a knob portion 9*a*. The knob portion 9*a* is located on the attaching portion 7 of the base sheet 2.

Examples of materials for forming the strip 9 include a nonwoven fabric sheet and a plastic sheet. In this case, as the nonwoven fabric sheet and plastic sheet, the same materials as those of the nonwoven fabric sheet and plastic sheet which are used for the base sheet 2 can be used.

The formed shape of the strip 9 is rectangular in the present embodiment. However the shape is not limited to the rectangular shape. The shape may be arbitrary shapes such as square, oval, and triangular shapes.

The bonding areas 12 and 13 of strip 9 and the cleaning-side sheet 3 are formed into a linear shape. As a means for forming such bonding areas 12 and 13, the heat sealing, the adhesive bonding, the ultrasonic sealing or the like can be used.

In the case of the adhesive bonding, the same adhesives as those for bonding the base sheet 2 to the cleaning-side sheet 3 can be used.

A mark for pulling out 14 is formed near the bonding area 12 of the strip 9. The mark for pulling out 14 is formed to visually check an allowable location for pulling out the strip 9. Any forming method can be used as long as a mark is formed. For example, the mark can be formed as a linear coloring portion with arbitrary coloring.

As for the strip 9 and the cleaning-side sheet 3 in the region between the bonding areas 12 and 13, the both whole surfaces may be solidly bonded.

A coloring portion 15 is formed at the edge portion of the knob portion 9*a* of the strip 9 so as to be easily seen with the user's eyes the knob portion 9*a*. Although it is preferable that the color specification of the coloring portion 15 is different from the color specification of the mark for pulling out 14, both of the color specifications may be the same.

When the cleaning sheet 1 of the present invention is attached to the base plate of the cleaning apparatus, the knob portion 9*a* of the strip 9 is projected from the cleaning side. In order to improve the usability, it is preferable that the knob portion 9*a* is temporary joined to the attaching portion 7 of the cleaning sheet 1 in advance until the strip 9 is used. The temporary joint is performed by dot-bonding a knob portion 9*a* to the attaching portion 7 by a dot-shaped bonding area 16 as shown in FIG. 8.

The dot-shaped bonding area 16 is formed by the spot heat sealing, the adhesive bonding, the ultrasonic sealing or the like.

A perforation 17 for cutting is formed in the cleaning-side sheet 3 in the region corresponding to the strip 9.

The perforation 17 is configured as an outline surrounding the strip 9, and the size and shape of the outline can be designed arbitrarily.

The perforation 17 may have a structure which is cut off when pulling the strip, and can be configured, for example, as a perforation with a form that a lot of dot-shaped cut portions are successively formed, i.e., a dotted line having a perforation shape. Further, the perforation 17 may be formed so that the cleaning-side sheet 3 is cut once so as to surround the strip 9, and this cutting-plane line is dot-shaped bonded at every predetermined interval with an adhesive having weak adhesive force or by a weak thermal fusing.

The length around the perforation 17 surrounding the strip 9 may be a length that base ends 17*a* of the perforation 17 reach positions of the bonding areas 4 or may be a length that the base ends 17*a* of the perforation 17 do not reach the positions of the bonding areas 4 and stop in front of the positions. FIGS. 1 and 8 show an embodiment in which the base ends 17*a* are formed at a length that the base ends 17*a* reach positions of the bonding areas 4.

The pressure-sensitive adhesive layer 18 is formed in a downward position from the cleaning-side sheet 3 of the region so as to be exposed outward by cutting the cleaning-side sheet 3 in the region surrounded by the perforation 17.

The pressure-sensitive adhesive layer 18 is formed in a downward position from the cleaning-side sheet 3 of the region so as to be exposed outward by cutting off the cleaning-side sheet 3 in the region surrounded by the perforation 17.

The pressure-sensitive adhesive layer 18 is formed by bonding an adhesive sheet obtained by applying a pressure-sensitive adhesive on a base film to the base sheet 2 with an adhesive.

Usable examples of the pressure-sensitive adhesive include pressure-sensitive adhesives, such as a synthetic rubber-based, natural rubber-based, and acryl-based pressure-sensitive adhesives. As the pressure-sensitive adhesive, a hot melt type adhesive can be used. As the hot melt type adhesive, for example, a hot melt type adhesive (product number: 5Q122E, DMC5266, manufactured by National Starch and Chemical Company (Shanghai)) can be used.

Usable examples of the base film include films of polypropylene, polyethylene, polyester, ethylene vinyl acetate copolymer, vinyl chloride.

It may be configured that a pressure-sensitive adhesive is directly applied to the base sheet 2 to form the pressure-sensitive adhesive layer 18 without using the above-described adhesive sheet.

A release agent layer 19 is formed on the back surface of the strip 9 bonded to the cleaning-side sheet 3 in the region surrounded by the perforation 17, namely the surface of the strip 9 at the side facing the pressure-sensitive adhesive layer 18. As the release agent forming the release agent layer 19, for example, a silicon-based release agent is used.

Further, while not particularly illustrated, a release agent layer is formed on the back surface of the cleaning-side sheet 3 in the region surrounded by the perforation 17. In this case, the release agent layer may be formed all over the back surface of the cleaning-side sheet 3. The release agent layer may be formed on a part of the surface of the sheet 3. When the release agent layer is formed on the part of the surface of the sheet 3, the release agent layer is formed in a portion excluding the bonding areas of the cleaning-side sheet 3 and the strip 9. When the release agent layer is formed all over the back surface of the cleaning-side sheet 3, the strip 9 is bonded to the cleaning-side sheet 3 via the release agent layer.

Figure 12:
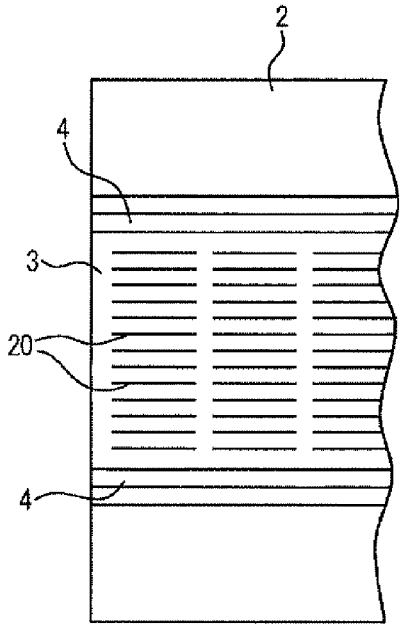
FIG. 12 is a main part plan view showing an embodiment where a lot of cut lines are formed in the cleaning-side sheet.
Figure 13:
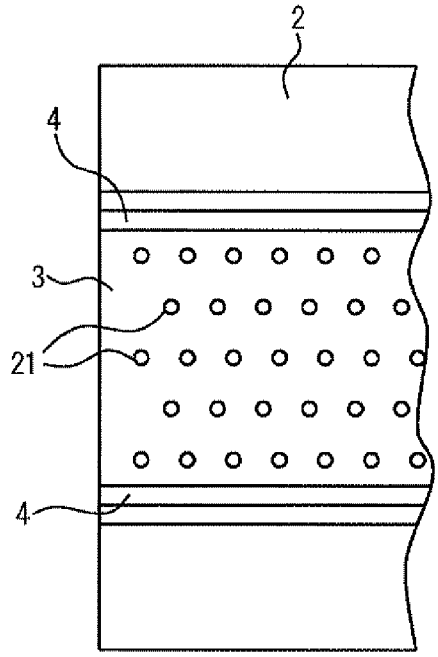
FIG. 13 is a main part plan view showing an embodiment where a lot of small holes are formed in the cleaning-side sheet.

As shown in FIG. 12, a lot of the cut lines 20 can be formed in the cleaning-side sheet 3. Further, a lot of the small holes 21 can also be formed in the sheet 3 as shown in FIG. 13.

The cut lines 20 and the small holes 21 are formed on the whole surface of the cleaning-side sheet 3, including the region portion surrounded by the perforation 17 in the sheet 3.

Figure 14:
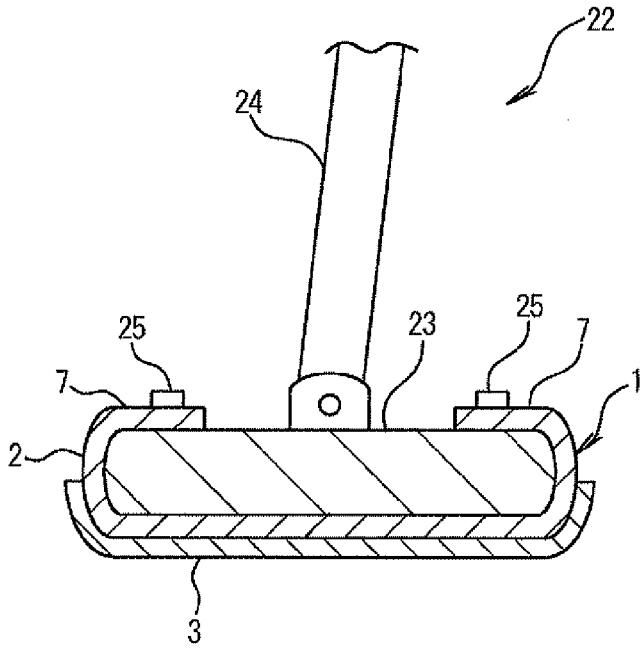
FIG. 14 is a longitudinal sectional view showing a state where the cleaning sheet is attached to a cleaning apparatus.

The cleaning sheet 1 formed in the above-described manner is attached to a base plate 23 of a cleaning apparatus 22 for floor cleaning and used as shown in FIG. 14. The cleaning apparatus 22 includes a handle 24 and the base plate 23 connected to the end of the handle 24. The cleaning sheet 1 is attached along the surface of the base plate 23 so that the cleaning-side sheet 3 is located outside. The attaching portion 7 of the cleaning sheet 1 is fixed on the upper surface of the base plate 23 by a stopper 25.

When the cleaned side is cleaned using the cleaning apparatus 2, the cleaning-side sheet 3 is adsorbed to the dust and dirt particles on the cleaned side to remove them. Here, the knob portion 9*a* of the strip 9 is fixed to the attaching portion 7 for temporary joint. Thus, even when the cleaning-side sheet 3 touches the cleaned side, the knob portion 9*a* dose not become dirty.

As shown in FIGS. 12 and 13, when a lot of the cut lines 20 and the small holes 21 are formed in the cleaning-side sheet 3, dust and dirt particles are caught in gap portions included by the cut lines 20 and the small holes 21, so that the cleaning capacity can be increased.

As for the case where the large dust particles or the heavy dust particles, such as grains of rice and small pieces of metal are present in the dust particles to be caught, when there is difficulty in catching the dust particles by the cleaning-side sheet 3, those dust particles can be caught by the pressure-sensitive adhesive layer 18 as described below. When catching the dust particles by the pressure-sensitive adhesive layer 18, the pressure-sensitive adhesive layer 18 is exposed in the following procedure.

Figure 9:
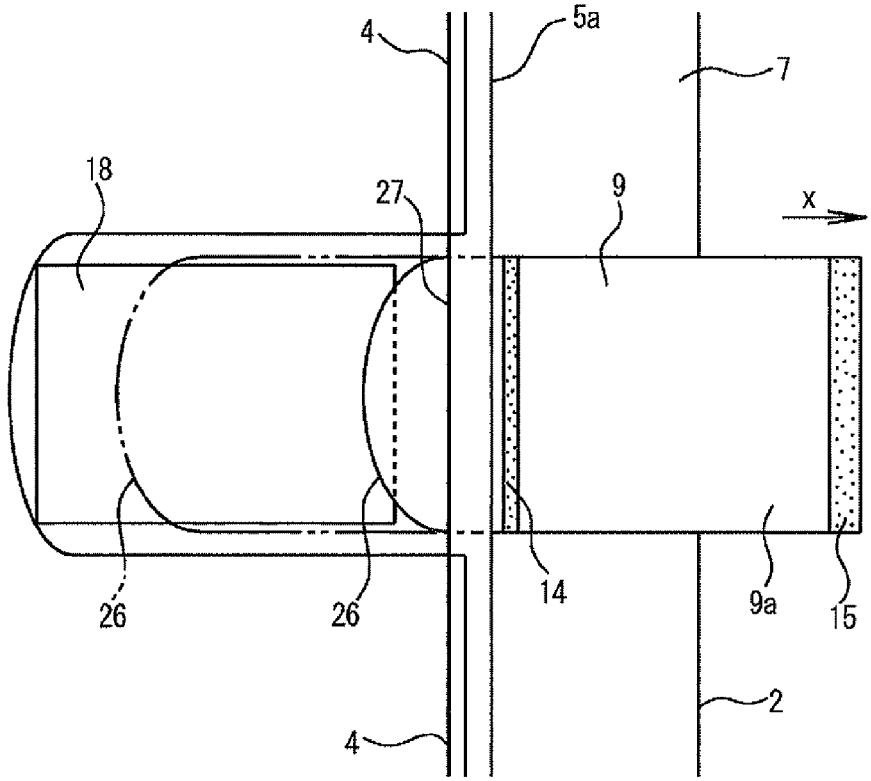
FIG. 9 is a main part plan view showing a state where a cut piece is moved.

That is, the knob portion 9*a* of the strip 9 is first grasped and pulled by hand, the knob portion 9*a* which is temporarily-jointed by the dot-shaped bonding area 16 is removed from the attaching portion 7, and then the knob portion 9*a* is pulled in a horizontal direction (in an arrow x direction in FIG. 9).

Figure 10:
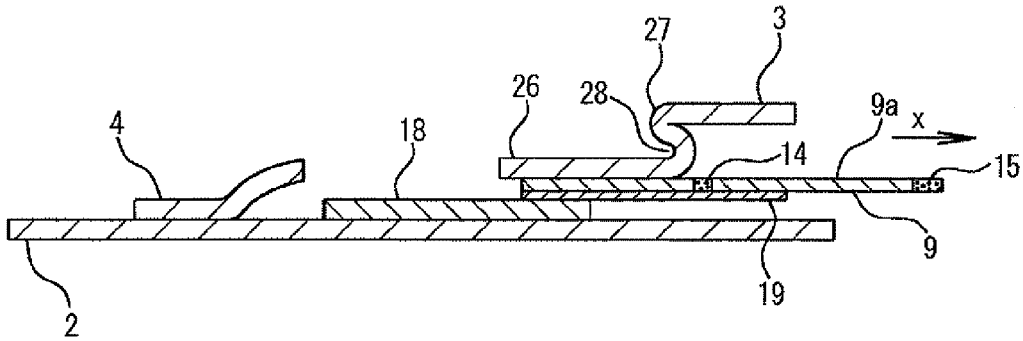
FIG. 10 is a longitudinal sectional view showing the state where the cut piece is moved.
Figure 11:
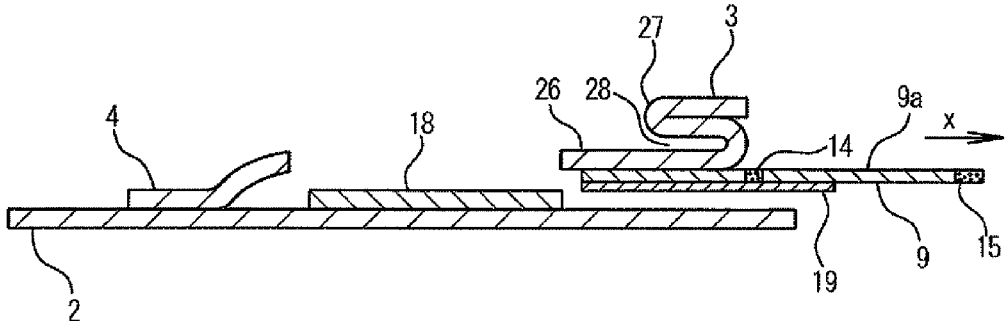
FIG. 11 is a longitudinal sectional view showing a state where the cut piece is moved and a pressure-sensitive adhesive layer is exposed.

The perforation 17 is broken by the pulling force in this case, the cleaning-side sheet 3 is cut in the region surrounded by the perforation 17, and a cut piece 26 is formed by that as show in FIGS. 9, 10, and 11. Thus, the strip 9 is a pulling piece for cutting the region surrounded by the perforation 17 of the cleaning-side sheet 3 and is formed of a material with a tensile strength necessary to break the perforation 17.

Since the release agent layer 19 is formed on the back surface of the strip 9, the strip 9 is not attached to the pressure-sensitive adhesive layer 18 so as to be adhesively jointed thereto when cutting the cleaning-side sheet 3 by pulling the strip 9.

The release agent layer is formed on the back surface of the cleaning-side sheet 3 in the region surrounded by the perforation 17, and thus the cleaning-side sheet 3 in the region is not attached to the pressure-sensitive adhesive layer 18 so as to be adhesively jointed thereto. Therefore, when pulling the knob portion 9*a* in an x direction to break the perforation 17, the cleaning-side sheet 3 in the region is smoothly pulled in the direction without being attached to the pressure-sensitive adhesive layer 18. The cleaning-side sheet 3 bonded to the strip 9 by the bonding areas 12 and 13 is pulled in the x direction by the strip 9 and the perforation 17 is broken. As a result, the cleaning-side sheet 3 in the region surrounded by the perforation 17 is easily cut and the cut piece 26 is formed.

When the cut piece 26 is formed, as the strip 9 is moved in the x direction, the cut piece 26 bonded to the strip 9 is moved in the same direction (FIGS. 9 and 10). In this case, the cut piece 26 is bent and a folding portion 27 is formed as shown in FIG. 10.

As the result of the formation of the folding portion 27, a concave portion 28 which is opened in a horizontal direction is formed.

As the movement of the strip 9 in the x direction becomes larger, the movement of the cut piece 26 in the same direction also becomes larger. This causes a larger depth of the concave portion 28 in the horizontal direction as shown in FIG. 11.

The concave portion 28 is formed in this manner. Thus, in cleaning before the formation of the cut piece 26, the dust and dirt particles which have been caught by the cleaning-side sheet 3 in the region surrounded by the perforation 17, among the dust and dirt particles caught by the cleaning-side sheet 3 are stored in the concave portion 28 with the movement of the cut piece 26 in the x direction.

For this reason, the dust and dirt particles caught in the region are stored and held in the concave portion 28.

Accordingly, there is no possibility that the dust and dirt particles which have been caught once are detached from the sheet side thereafter.

While the moving distance of the strip 9 is small, a tensile stress is not generated at the base ends 17*a* of the perforation 17. When the strip 9 is pulled to the maximum distance, the tensile stress is generated at the base ends 17*a*. Accordingly, even if the strip 9 is further pulled, the strip 9 is not moved and stopped in the position. Thus, the base ends 17*a* serve as a stopper.

When the strip 9 reaches the maximum movement position, the mark for pulling out 14 colored by a predetermined color is configured to appear near the edge portion Sa of the cleaning-side sheet 3 as shown in FIG. 9. Therefore, a defect such that the strip 9 is pulled more than necessary by the user's force can be prevented.

The pressure-sensitive adhesive layer 18 formed on the base sheet 2 is appeared and exposed outward by moving the cut piece 26 in the x direction (FIGS. 9 and 11).

The surface of the pressure-sensitive adhesive layer 18 exposed is pressed against the large dust particles or the heavy dust particles, such as grains of rice and small pieces of metal, so that those dust particles can be attached to the surface of the pressure-sensitive adhesive layer 18 to catch them. The large dust particles or the heavy dust particles can be easily caught by an effect of the pressure-sensitive adhesive of the pressure-sensitive adhesive layer 18.

The effect of the pressure-sensitive adhesive layer 18 is not limited to the case where the large dust particles and the heavy dust particles are caught, and it may be used for catching small dust particles and light dust particles. For example, at the time of cleaning the cleaned side, when the small dust particles and the light dust particles which have been caught once by the cleaning-side sheet 3 are detached from the surface of the above-described sheet 3 thereafter and fallen on the cleaned side, pushing the surface of the pressure-sensitive adhesive layer 18 against the fallen dust particles enables those dust particles to be reliably attached and held.

FIGS. 9, 10, and 11 do not illustrate the cleaning sheet 1 with being attached to the base plate 23 of the cleaning apparatus 22, but the cleaning sheet 1 with being flatly unfolded, and show the movement of the cut piece 26 when the knob portion 9*a* of the strip 9 is pulled in such an unfolded state.

In the above-described embodiment of the present invention, the example when the cleaning sheet is configured so as to have the cleaning-side flat structure as shown in FIG. 3 has been explained, however the present invention is not limited thereto. Similarly, the embodiment when the cleaning sheet is configured so as to have the cleaning-side swelling structure as shown in FIG. 5 can be used.

When the cleaning sheet is configured so as to have the cleaning-side swelling structure, the length of the cut piece 26 along the x direction in FIG. 9 (a length from the base end 17*a* to a tongue-shaped end 11 (FIG. 8)) can be formed longer than the length of the cut piece 26 in the case of the cleaning-side flat structure. As a result, the depth in the horizontal direction of the concave portion 28 which is formed by the movement of the cut piece 26 is lengthen as much as the length of the cut piece 26 formed. Thus, there is an advantage that the dust particles are more reliably stored and held.

In the cleaning-side swelling structure, when the cut lines 20 and the small holes 21 are formed in the cleaning-side sheet 3 as shown in FIGS. 12 and 13, some of the dust and dirt particles which have been caught by the cut lines 20 and the small holes 21 may enter the space portion 8 between the cleaning-side sheet 3 and the base sheets 2 through the cut lines 20 and the small holes 21 in some cases. Thus, the effect such that the dust and dirt particles are stored and held when the dust dirt particles enter the space portion 8 is caused.

In the above-described embodiment of the present invention, the structure in which the cleaning-side sheet 3 is bonded to one side of the base sheet 2 has been described, however the present invention is not limited thereto. The cleaning-side sheet 3 may be bonded to both sides of the base sheet 2. In this case, the strip 9 is formed on each of the cleaning-side sheets 3.

According to this embodiment, both sides of the cleaning sheet can be used as a cleaning side. When cleaning using both sides, the dust particles can be caught by exposing the pressure-sensitive adhesive layer 18.

In the above-described embodiment of the present invention, the example of the cleaning sheet which is used by attaching to the cleaning apparatus for floor cleaning has been explained, however the present invention is not limited thereto. It can be similarly used as a cleaning sheet for handy mop which is used by attaching to the end of a short handle.

It can be similarly used as a cleaning sheet which is applied to a mitten-type cleaning tool which performs cleaning by inserting a hand into a glove-shaped tool.

INDUSTRIAL APPLICABILITY

The present invention can be attached to, for example, the cleaning apparatus for floor cleaning to use for floor cleaning and can catch relatively large dust particles, so that it is useful as a cleaning sheet.

The invention claimed is:

1. A cleaning sheet obtained by bonding a cleaning-side sheet to a base sheet at bonding areas, interposing a strip between the base sheet and the cleaning-side sheet, bonding the strip to the cleaning-side sheet, so that one end of the strip projects outward from the cleaning-side sheet, forming a perforation for cutting the cleaning-side sheet bonded with the strip in the region surrounded by the perforation in the cleaning-side sheet, and forming a pressure-sensitive adhesive layer on a surface of the base sheet which faces the region of the cleaning-side sheet surrounded by the perforation.

2. The cleaning sheet according to claim 1, wherein a nonbonded area is formed in the bonding areas at an edge portion at one side among the bonding areas between the base sheet and the cleaning-side sheet and the end of the strip projects outward from the cleaning-side sheet through a gap portion between the base sheet and the cleaning-side sheet in the nonbonded area.

3. The cleaning sheet according to claim 1, wherein the cleaning-side sheet is configured so that the region of the cleaning-side sheet surrounded by the perforation is cut by pulling the strip.

4. The cleaning sheet according to claim 1, wherein the pressure-sensitive adhesive layer is formed on the surface of the base sheet so as to be exposed outward by cutting the cleaning-side sheet bonded with the strip in the region surrounded by the perforation.

5. The cleaning sheet according to claim 1, wherein the perforation is formed as dotted-line in a cleaning side sheet.

6. The cleaning sheet according to claim 1, wherein a release agent layer is formed on the surface of the strip facing the pressure-sensitive adhesive layer.

7. The cleaning sheet according to claim 1, wherein a projected portion of the strip is formed as a knob portion.

8. The cleaning sheet according to claim 1, wherein a region where the base sheet is exposed outward from the edge portion of the cleaning-side sheet is formed and the region is configured as an attaching portion.

9. The cleaning sheet according to claim 8, wherein the knob portion of the strip is dot-bonded to the attaching portion.

10. The cleaning sheet according to claim 1, wherein a mark for pulling out with coloring is formed in the strip.

11. The cleaning sheet according to claim 1, wherein a lot of cut lines or small holes are formed in the cleaning-side sheet.

12. The cleaning sheet according to claim 1, wherein the cleaning-side sheet is bent into an arch shape and bonded to the base sheet and a space portion is formed between the cleaning-side sheet and the base sheet.

* * * * *